United States Patent [19]

Fletcher et al.

[11] 4,093,463

[45] June 6, 1978

[54] WATER SOLUBLE BINDER OVERCOAT ON VESICULAR ELEMENT CONTAINING $N_2$-RELEASING AGENT

[75] Inventors: George Leland Fletcher, Pittsford; Michael Mosehauer, Spencerport, both of N.Y.

[73] Assignee: Eastman Kodak Company, Rochester, N.Y.

[21] Appl. No.: 770,969

[22] Filed: Feb. 22, 1977

[51] Int. Cl.[2] ..... G03C 1/52; G03C 1/68

[52] U.S. Cl. ..... 96/67; 96/91 R; 96/114.1; 96/27 R; 96/75

[58] Field of Search ..... 96/75, 27 R, 114, 114.1, 96/67, 91

[56] References Cited

U.S. PATENT DOCUMENTS

| | | | |
|---|---|---|---|
| 3,046,131 | 7/1962 | Schmidt et al. | 96/91 D |
| 3,536,490 | 10/1970 | Hochberg et al. | 96/47 |
| 3,759,711 | 9/1973 | Rauner et al. | 96/36 |

*Primary Examiner*—John D. Welsh

*Attorney, Agent, or Firm*—D. M. Schmidt

[57] ABSTRACT

A light-sensitive vesicular imaging element and a method of manufacture are provided, comprising a vesiculating layer which includes a binder and vesiculating agent which liberates gas upon exposure to activating radiation, and an overcoat which contains a polymer soluble in a solvent in which the binder of the vesiculating layer is substantially insoluble. Upon imagewise irradiation of the element, gas bubbles are generated in the exposed areas. The bubbles may be developed to a visible record by overall heating.

19 Claims, 4 Drawing Figures

WATER SOLUBLE BINDER OVERCOAT ON VESICULAR ELEMENT CONTAINING $N_2$-RELEASING AGENT

BACKGROUND OF THE INVENTION (1) Field of the Invention

The invention relates to vesicular imaging and to elements used therein. In particular, it relates to novel vesicular imaging elements which include an overcoat, and methods of making and using the element.

(2) State of the Prior Art

The first commercial vesicular photographic materials utilized gelatin binders. Gelatin was replaced with improved binder materials due to the undesired tendency of gelatin to absorb moisture and therefore to release the image-forming bubbles, destroying the image. Typical improved materials included a great variety of synthetic polymers, such as poly(vinyl chloride), poly(vinylidene chloride), and polystyrene; and copolymers obtained by copolymerizing acrylonitrile with vinyl chloride, styrene, vinylidene chlorofluoride, or 1,1-difluoroethylene; by copolymerizing vinyl chloride with methyl acrylate, acrylic acid, diethyl maleate, or vinyl acetate; or by copolymerizing vinylidene chloride with vinyl chloride, vinyl acetate, vinyl alcohol, ethyl acrylate, or acrylonitrile. Examples of the homo- or co-polymers of vinylidene chloride are described in U.S. Pat. No. 3,032,414, issued to R. James.

To be suitable, a binder must be sparingly permeable, must have the proper diffusivity for the light-generated gas, and must have the proper rigidity for generating the image-forming vesicles. Of these three characteristics, permeability and diffusivity are approximately proportional, and even rigidity is related to permeability, as is noted in the aforesaid U.S. Pat. No. 3,032,414. Thus, it is generally sufficient to evaluate only the permeability constant (PC) of a material to determine if the material is satisfactory as a binder. This constant is most readily expressed as PC, equal to the number of cubic centimeters of gas transmitted by 1 square centimeter of the binder material during one second at constant temperature, when the pressure gradient is one centimeter of mercury per centimeter of the thickness of the binder layer, or $cm^3 cm^{-2} sec^{-1} (cm\ Hg/cm)^{-1}$. One method of expressing the range of useful permeability has been that the binder should have a PC of between about $1 \times 10^{-11}$ as $PC_{max}$, and about $1 \times 10^{-15}$ as $PC_{min}$, at a temperature of 30° C. See, for example, U.S. Pat. No. 3,355,295 to Priest.

The most commonly used vesiculating agents are diazonium salts of various kinds. Upon exposure to activating radiation these salts release nitrogen gas. Because of the permeability constant of the binder as described above, the gas is retained within the element until development by heat causes expansion of the gas into light-scattering vesicles. Typical examples of such diazonium salts are taught in U.S. Pat. No. 3,355,295 and in Kosar, *Light-Sensitive Systems,* (1965), page 277.

It has been recognized in a number of instances that the characteristic high contrast and relatively low speed of vesicular elements need modification. The high contrast is undesirable as it renders it difficult to reproduce a "gray scale". To solve these problems, other vesiculating agents such as azides have been used as in British Pat. No. 956,336 or French Pat. No. 1,281,905, but such other vesiculating agents tend to lack the stability of diazonium salts.

Still other approaches to removing the above-noted problems have involved the addition of other components to the element, such as a dispersible water-soluble organic colloid as in U.S. Pat. No. 2,703,756, or the use of special processing techniques such as a heat treatment, shown for example in U.S. Pat. No. 3,149,971. However, such composition or process additives have introduced an added cost element.

Overcoating has also been tried as a technique to reduce the contrast and increase the speed, as shown for example in U.S. Pat. No. 3,615,475 and U.S. Pat. No. 3,143,418. However, these techniques have certain drawbacks. For example, the overcoat layer of the U.S. Pat. No. 3,615,475 patent includes its own vesiculating agent, and an extension of sensitometric characteristics is provided by requiring that each binder have a different permeability constant so that the exposure of both layers to the same image will produce different densities in each layer. Of course, the fact that a vesiculating agent must be used in both layers introduces an additional expense, and the binders or polymers used are restricted in that significantly different permeability constants are required.

Furthermore, in the teachings of both U.S. Pat. No. 3,143,418 and U.S. Pat. No. 3,615,475, there is no appreciation that when the element is coated the solubility of the overcoat should be different from that of the vesiculating layer. Instead, in the U.S. Pat. No. 3,143,418 patent, for example, the overcoat and the vesiculating layer polymers both can be, e.g., poly(vinyl alcohol). It has been found that the use of the same polymers creates coating difficulties due to "strike-through" of the solvent.

Vesicular elements have also been overcoated for other purposes, for example, using as the overcoat layer a silver-salt emulsion which can be thermographically developed, such layer thereafter being used to subsequently imagewise expose the vesicular layer to ultraviolet radiation. Typical of patents disclosing a silver-salt emulsion overcoated onto a vesiculating layer is U.S. Pat. No. 3,515,547. By virtue of the double exposure and development required in such techniques, they cannot provide an imaging element which relies solely upon the vesiculating agent as the image-providing means.

Diazotype photosensitive materials have been overcoated with polymeric layers to transparentize the photosensitive layer, or to increase the sensitivity of the diazo salt. Such materials are not vesicular elements, and no attempt is made in such cases to insure that the polymeric binder of the diazo salt is substantially insoluble in the solvents used for the polymer of the overcoat. U.S. Pat. Nos. 3,370,949 and 3,353,984 are representative of such disclosures, the latter patent providing for the same polymeric binder to be used in both coatings.

Yet other instances of overcoats applied to a vesicular imaging element are those in which the element, after exposure and development, is coated with a hydrophobic substance to give added water resistance, as shown, for example, in U.S. Pat. No. 2,908,572, or wherein a water-swellable layer is added to permit transfer of the imaging layer, as shown for example in British Pat. No. 1,330,537. Of course, overcoats added after development are incapable of increasing the speed of the element, and transfer layers have not been recognized as solving speed or contrast problems. Furthermore, the transfer layer of the British patent is soluble in the solvent used with the vesiculating layer binder.

Protective overcoats have been applied to photothermographic elements other than vesicular elements, as disclosed for example in U.S. Pat. No. 3,856,526. However, the purpose of such overcoats therein was to provide mechanical protection, and in no way did such overcoats increase the speed and decrease the contrast of the actual image.

Patents relating only to the general background of photothermographic elements include U.S. Pat. Nos. 3,383,213; 2,699,392; 3,620,743; 3,622,335; 3,622,336, 3,933,508; and British Pat. No. 645,825.

OBJECTS OF THE INVENTION

It is an object of the invention to provide a vesicular imaging element exhibiting reduced contrast and enhanced speed, without requiring the use of vesiculating agents other than in the primary image-forming layer.

It is a related object of the invention to provide such an element without requiring elaborate additives or processing.

Other objects and advantages will become apparent upon reference to the following Summary of the Invention and Discussion of Preferred Embodiments, when viewed in light of the attached drawings.

SUMMARY OF THE INVENTION

The invention concerns an improved vesicular imaging element which exhibits increased speed and lower contrast.

More specifically, there is provided a radiation-sensitive vesicular imaging element comprising, in laminar relationship, (a) a support, (b) a first layer comprising a binder that is substantially soluble in an organic solvent and, uniformly distributed in the binder, a radiation-sensitive gas-producing vesiculating agent; and (c) a second layer superimposed over the first layer, the second layer comprising a water-soluble binder that is substantially insoluble in the organic solvent, the second layer being substantially free of radiation-sensitive material, the binders together providing a latent image stability period for $N_2$ that is sufficient for vesicular imaging.

Such an element can be formed by coating on a support a first polymeric layer having a binder soluble in an organic solvent, and uniformly distributed in the binder, a radiation-decomposable vesiculating agent capable of generating a gas upon imagewise exposure; drying the coating; superimposing over the dried coating a second layer comprising a water-soluble binder that is substantially free of a radiation-sensitive compound; and drying the overcoat.

The element so formed is then used by imagewise exposure and by development by heating to a temperature and for a time sufficient to expand into image-forming bubbles the gas formed as a result of the decomposition of the vesiculating agent.

DESCRIPTION OF THE PREFERRED EMBODIMENTS

Figure 1:
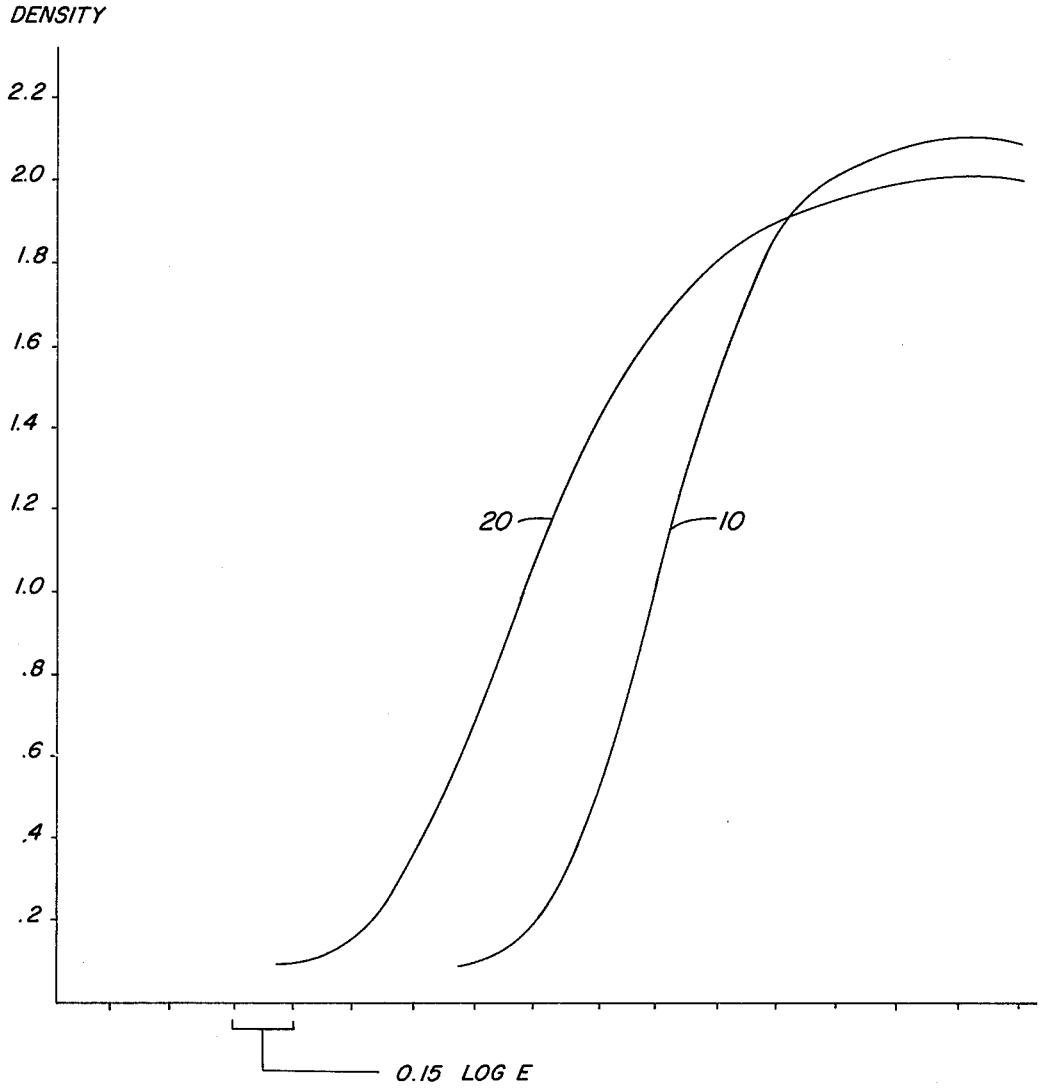
FIGS. 1–4 show D-log E curves developed for vesicular imaging elements prepared in accordance with the invention, contrasted with similar elements prepared in accordance with the prior art.

The invention concerns improved vesicular imaging elements, and as such concerns generally imaging elements coated in a film format such as on a suitable support. However, it will be appreciated that the invention also includes any imaging element utilizing the improved compositions hereinafter described.

This invention provides vesicular imaging elements exibiting increased speed and reduced contrast prepared by overcoating a vesicular imaging element with a layer of a water-soluble polymer, which layer is substantially free of a vesiculating or any other imaging agent. As used herein, "substantially free" means lacking amounts which would be operative to create, in the overcoat layer, a useful image, when exposed to the conditions used to expose the vesicular layer. The vesicular layer binder preferably is substantially insoluble in water, and the combined gas impermeability of the two layers preferably is sufficient to retain the gas of the vesiculating agent for a minimum storage period. Therefore it is not necessary, as in certain prior art techniques, that the overcoat be meticulously selected with a permeability constant which is substantially different from that of the polymer in which the vesiculating agent is confined. Indeed, such differences in permeability constants may be detrimental if the overcoat is rendered too permeable.

As used herein, "substantially insoluble" and "nonsolvent" mean that the solubility of the polymer in the solvent in question is less than that which is suitable for the preparation of a solution suitable for coating. Quantitatively, such insolubility generally requires that less than about 1.0% of the total coating solution weight be the polymer in solution.

Conversely, a polymer that is soluble or substantially soluble in a given solvent is one whose solubility will permit the preparation of solutions suitable for such coating. Quantitatively, as used herein, polymers are "substantially soluble" in a given solvent if at least about 1.0% of the polymer, measured per total solution weight, is soluble.

Without being limited to a particular theory, it is believed that the mutual exclusivity of the solvents usable with the binders of the two layers insures that the desired improvement will be developed because solubility in the same solvent causes strike-through during coating. That is, similar solubility of the polymers of the two layers causes the solvent of the second, overcoat layer to penetrate the already-coated layer containing the vesiculating agent, and to at least partially redissolve that layer. It is this strike-through which appears to render ineffective the overcoat as a means for improving the speed and the contrast.

Preferably the binder in which the vesiculating agent is uniformly distributed is one which is substantially insoluble in water but is soluble in organic solvents. Such a polymer is hereinafter called a Type I polymer or binder. The overcoat comprises a polymer that is soluble in water and substantially insoluble in organic solvents. Such water-soluble polymers are hereinafter called Type II polymers or binders. Highly preferred examples of Type I polymers include homopolymers and copolymers of alpha-chloroacrylonitrile and blends or mixtures of such homopolymers with other water-insoluble polymers, such as are disclosed for example in U.S. Pat. No. 3,620,743; copolymers and terpolymers of vinylidene chloride, such as poly(vinylidene chloride-co-acrylic acid-co-acrylonitrile); poly(vinyl chloride); poly(4-vinylpyridine); polystryene; copolymers obtained by copolymerizing acrylonitrile with vinyl chloride, styrene, vinylidene chlorofluoride, or 1,1-difluoroethylene; polymers obtained by copolymerizing vinyl chloride with methyl acrylate, acrylic acid, diethyl maleate, or vinyl acetate; or copolymers obtained by copolymerizing vinylidene chloride with vinyl chloride, vinyl acetate, vinyl alcohol, ethyl acrylate, or acrylonitrile; and bisphenol A/epichlorohydrin copolymers. Bisphenol A as used herein is intended to mean 4,4'-isopropylidene diphenol, also known as 2,2-(p-hydroxyphenyl) propane. Of this group, highly preferred are mixtures of poly(α-chloroacrylonitrile) and poly(vinylidene chloride-co-acrylonitrile) in weight ranges of about 85:15 to about 95:5, respectively.

For all of the preceding Type I polymers, organic solvents are required. The particular solvent selected will usually depend on the actual polymer selected. Typical preferred examples of such solvents include, either alone or in appropriate combination, methyl ethyl ketone, butyrolactone, ethanol, methoxyethanol, methylethylketone, and acetone.

Still other highly preferred examples of such useful, Type I polymers include polysulfonamides containing as a portion of the polymer backbone or as a pendant moiety, the group $>N—SO_2—$, and having a wavelength of maximum absorption, λmax, which is no greater than about 350 nm in the spectral range of 200–750 nm, when measured in solution with either ethanol or methoxyethanol. Particularly useful classes of such polymers include polymers containing toluene-2,4-disulfonamide units and those containing N-(vinylphenyl)sulfonamide units. Such binders can be homopolymers, copolymers or physical mixtures of the same. Whether the polymer is an addition polymer or a condensation polymer, a certain portion of the polymer should be recurring sulfonamide groups such as $—SO_2-N<$groups, so that the weight percent of sulfur is at least about 4%. Suitable solvents for such polymers include 2-methoxyethanol; 4-butyrolactone; N,N-dimethylformamide; and mixtures of acetone and methoxyethanol. Other details concerning these poly(sulfonamide) binders, and their methods of preparation, are disclosed in *Research Disclosure,* Vol. 131, Publication No. 13107, March 1975, published by Industrial Opportunities Ltd., Homewell, Havant Hampshire P091EF United Kingdom, the details of which are expressly incorporated herein by reference.

Yet another useful class of such polysulfonamide binders includes the class having the general formula.

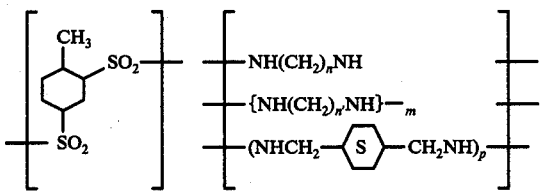

wherein $n$ and $n'$ are the same or different and are each a positive integer from 2 to 12; $m$ is zero or one; and $p$ is 0 when $m$ is other than 0, and is 1 when $m$ is 0.

Still other highly preferred Type I binders useful in the invention include polyesters prepared from dibasic aromatic acids and polyhydric alcohols such as glycols and/or bisphenols. Suitable solvents for such polymers include dichloromethane, dichloroethane, and trichloroethane. Representative examples and further details of their use can be found in *Research Disclosure,* Vol. 140, Publication No. 14042, December 1975, the contents of which are expressly incorporated herein by reference.

Highly preferred examples of Type II polymers include for example, poly(vinyl alcohol), poly(acrylamide), poly(acrylic acid), gelatin and sodium carboxymethyl cellulose. Such polymers have sufficient solubility in water as will permit film formation as by coating from a water solution.

It is contemplated that even Type II overcoat polymers which by themselves are too permeable to retain the vesiculating gas will provide elements which demonstrate increased speed if they are used in combination with a suitable Type I polymer when compared to an identical element constructed without the overcoat.

In selecting a polymer of either Type I or Type II as described above, the molecular weight of the polymer appears to be of little consequence. The much higher molecular weight polymers tend to have a higher viscosity, which may require an adjustment in coating techniques as is well-known. Polymers having intrinsic viscosities between 0.5 and 1.2 centipoise are acceptable.

In accordance with another aspect of the invention, the gas impermeability of the two layers of the element need be controlled only to the extent of providing a minimum retention of the vesiculating gas that will just barely permit the formaton of a vesicular image. Such impermeability is defined in the art, such as U.S. Pat. No. 3,032,414, by means of a permeability constant ranging between $10^{-11}$ and $10^{-15}$, at 30° C, with the units of $cm^3 cm^{-2} sec^{-1} (CM\ Hg/cm)^{-1}$. In a composite element, as in this invention, the impermeability or the ability to control the diffusible gas is preferably measured on the entire composite, rather than the individual layer, because the overcoat may sufficiently retard the diffusion of the vesicular gas in situations wherein the element without the overcoat cannot.

A method of determining the gas impermeability of an element that is more convenient than the above-described techniques has also been found. This novel method involves determining the latent image stability period of the element and comparing it against a standard. As used herein, "latent image stability period" means the length of time the latent vesicles, generated by the exposure steps defined below, and necessary to form an image during development, require to diffuse out of the element when stored at 54° C to the point that no image greater than a density of 0.2 is developable. A useful test for making this determination comprises subjecting a candidate element, when fully manufactured, to the steps of (a) exposing the element for 18 seconds at ambient temperature through a carbon step wedge to an undoped mercury arc lamp at a distance of about 7.6 cm, (b) storing the exposed element at 54° C for various periods of time and, (c) developing the stored element by contacting it with an aluminum block at 145° C for three seconds to ascertain whether a developable image remains. The storage time after which no developable image of a density greater than 0.2 is obtainable is the latent image stability period. It has further been found that composite elements of the type described herein which produce satisfactory vesicular images are those in which the latent image stability period is greater than about two minutes when measured in a test element constructed, as per the invention, so that the calculated total dried binder thickness, that is, for both layers, is about 11 microns, and the concentration of the vesiculating agent is about 10% by dry weight of the vesicular layer.

Highly preferred are those combinations in which the total gas impermeability is such that the latent image stability period, for the conditions of the test noted, is equal to or greater than about 30 minutes. Therefore, either binder itself can be more permeable than would be acceptable if used alone, provided the other binder adds sufficient impermeability.

As used herein, "dried" and "drying" is used to mean the condition or act of removal of all but residual solvent so that the coating is not tacky to the touch.

It will be appreciated that other factors can affect the actual values determined for the latent image stability period. One such factor, at least for polymers having polar sites, is the amount of residual solvent present in the polymer. Also, combined dried binder thicknesses greater than 11 microns will provide longer latent image stability periods. However, the effect of such factors is usually small and is generally much less than the overall latent image stability period desired of the element, i.e., one which is greater than about two minutes.

VESICULATING AGENT

The described vesiculating agent is selected to be compatible with the binder and solvent selected. In accordance with the invention, the agent is uniformly distributed within the primary imaging layer. Preferably no radiation-sensitive, gas-producing agent is in the overcoat. As used herein, "distributed" as applied to the vesiculating agent means either dispersed or dissolved, depending on the solubility of the agent in the binder of choice.

Typical vesiculating agents which can be useful with Type I binders, in the primary image-forming layer, include any $N_2$-releasing agent, such as diazonium salts, carbazido compounds, and azides. Highly preferred examples include 4-(diethylaminobenzene diazonium fluoroborate; 1,4-dicarbazidobenzene; 2-carbazido-α-naphthol; 2,5-dimethoxy-4-morpholinobenzene diazonium hexafluorophosphate; 4-methyl-amino benzene diazonium, 4-dimethylamino benzene diazonium and 4-diethylamino benzene diazonium chlorozincate; 4-phenylaminobenzene diazonium sulfate; N,N-dimethyl benzene diazonium fluoroborate; 4-(N-ethyl-N-hydroxyethylamino) benzene diazonium tetrachlorozincate; 1-diazo-2-hydroxynaphthalene-4-sulfonate; 4-benzoylamino-2,5-diethoxybenzene diazonium chloride; 4-cyclohexylamino-3-methoxybenzene diazonium-p-chlorobenzenesulfonate; 7-dimethylamino-8-methoxy-3-oxodihydro-1,4-thiazine-6-diazonium chloride; 4-dimethylamino-1-naphthalene diazonium fluoroborate; 3-oxo-7-dialkylaminobenzothiazine-diazonium fluoroborate; 1-carbazido-2,5-dihydroxybenzene; 2-amino-1-carbazidobenzene; 1,4-dicarbazido-2,3-dihydroxyfurane; p-diethylamino benzene diazonium chloride; 4-dimethyl-aminonaphthalene-1-diazonium chloride; ethylene bis(4-azidobenzoate); 4-azidoacetophenone; 2,6-bis(p-azodibenzylidene)-4-methylcyclohexanone; 2,4-diazido-6-methylpyrimidine; 4-azido-6-methyl-1,2,3,3a,7-pentaazaindene; 3- or 4-azidophthalic anhydride; and quinonediazides. All these agents are well known. The agent can be useful in concentrations of between about 1 and 15% of the weight of the binder.

The vesiculating or primary image-forming layer can be coated onto a suitable support. Any suitable photographic support having a minimum thickness of about 1 mil can be useful according to the invention. Typical supports include transparent supports, such as film supports and glass supports as well as opaque supports, such as metal and paper supports. The support can be either rigid or flexible. The most common photographic supports for most applications are paper or film supports, such as poly(ethylene terephthalate) film. Suitable exemplary supports are disclosed in *Product Licensing Index, Vol.* 92, December 1971, Publication 9232, at page 108 published by Industrial Opportunities Ltd., Homewell, Havant Hampshire PO1EF United Kingdom. The support can incorporate one or more subbing layers for the purpose of altering its surface properties to enhance the adhesion of the radiation-sensitive coating to the support. A typical example of a subbing material is the terpolymer of vinylidene chloride, acrylonitrile and vinyl chloride.

THE IMAGING ELEMENT

The composite imaging element is prepared by forming and drying on a support, the primary image-forming layer, preferably using a solvent in which the Type I binder containing the vesiculating layer is soluble, as described above, and thereafter coating and drying a second layer comprising a Type II polymeric binder dissolved in water. Conventional photographic coating techniques are useful for each of the two layers. The binder concentration in the solution for each of the primary image-forming layer and the overcoat can be between about 1.0 and about 20% by weight of the total solution. Typically, the solution for the primary image-forming layer is coated onto the support by such means as whirler coating, brushing, doctor-blade coating, hopper coating and the like, and similar techniques can be used to apply the overcoat over the primary image-forming layer. The amount of solids for the vesicular-containing layer should generally be between about 2.0 and about 5.0 $g/m^2$ of support, and the overcoat layer preferably has 0.15 to 0.3 $g/m^2$ solids.

Other exemplary coating procedures are set forth in the *Product Licensing Index,* Vol. 92, December 1971, Publication 9232, at page 109, and include melts which are extruded to form film.

Addenda, including surfactants and antioxidants, can be incorporated into the coating composition as disclosed on page 108 of the described *Product Licensing Index* publication. It is also possible to incorporate antistatic layers and/or matting agents as disclosed on this page of the *Product Licensing Index* publication. Matting agents introduced into or dispersed throughout the overcoat are preferably of a very fine size, such as no larger than about 20 microns to avoid interference with the magnified image presented during viewing. Particularly useful examples of such agents include silica and beads of synthetic polymers. Plasticizers can be incorporated to modify the coatability or flexibility of Type I binders, if desired. Dyes to enhance the neutral appearance of the background can also be added. To this end, blue dyes are useful when the binder is predominantly α-chloroacrylonitrile. Anticorrosive agents, such as propylene oxide, can be added to reduce the likelihood of formation of HCl gas.

Increased sensitivity can be achieved by certain conventional addenda added to the primary image-forming layer, at least some of which function as prenucleating agents which form sites for the gas bubbles, insuring a finer grain pattern. Examples of such prenucleating agents include waxes such as are described in U.S. Pat. No. 3,355,295 to Priest. Finely divided pigment having an index of refraction approximately equal to that of the binder also increases the sensitivity, as does exposure to high humidity.

The overcoat can be hardened, such as by crosslinking agents. Highly preferred examples of such agents include inorganic acids, such as HCl, in methanol or ethanol, with an orthosilicate salt such as tetraethyl orthosilicate.

In use, the preferred imaging element is imagewise exposed to ultraviolet light or visible light containing a strong ultraviolet component, such as is obtained from mercury arc lamps. Such exposure causes the decomposition of the vesiculating agent and the formation of $N_2$ gas. Development is achieved by heating the exposed element for a time and at a temperature sufficient to expand the gas within the exposed portion into vesicules. When the temperature of development is between about 80° and about 145° C, a few seconds of heating suffices.

If desired, the unexposed portion of the element thereafter can be conventionally flash-exposed and stored at a temperature and for a time sufficient to allow the predominant weight portion of the gas generated by said brief exposure to diffuse out of the element. Typically, storage can be for several hours at a temperature below about 45° C.

Such image-forming elements prepared and used as described above have been found to reduce the average contrast, compared to the same element without an overcoat, by as much as 1.8, where average contrast is defined to be the slope of a line drawn on a D-log E curve between a first density point of 0.5 above fog, and a second density point which is 1.0 above that first point. Also, the log E speed is increased by as much as 0.3, measured at a density value of 1.0.

EXAMPLES

The invention can be further illustrated by the following examples. The Figures of the drawings are illustrative of the nature of the improvements achieved, as shown in some of these examples.

EXAMPLE 1

A vesicular film was prepared as follows: A solution was prepared by dissolving 3.333 g of the homopolymer of alpha-chloroacrylonitrile and 0.600 g of poly(vinylidene chloride-co-acrylonitrile) ("Saran F-120", a trademark of Dow Chemical), in a matrix of 28.4 g of methyl ethyl ketone and 0.666 g of butyrolactone. The polymers were dissolved by gently heating and mild agitation. To the polymer solution was added 0.473 g of p-diazomethylaniline zinc chloride as the vesiculating agent. The diazonium salt was dissolved by gentle heating and stirring. The clear lacquer solution was coated at 37° C onto a 4 mil poly(ethylene terephthalate) film support and dried at 119° C to remove residual solvent.

An aqueous solution of poly(vinyl alcohol) was prepared by dissolving 7.00 g of poly(vinyl alcohol) in 75 g of water along with 1.0 g of "L-522", a nonionic organic silicone surfactant in wax form manufactured by Union Carbide. Solution was accomplished by stirring at room temperature. The poly(vinyl alcohol) solution was coated over the above-described vesicular film at a six mil wet coating thickness. The composite vesicular element was dried at 40° C for one minute to remove the solvent and further dried for 5 minutes at 119° C.

A sample of the above element was exposed to a 125 watt mercury arc spaced about three inches from the film through an image-bearing transparency for 16 seconds. The image was developed by heating the sample at 128° C for 3 seconds. The image characteristics of the composite film are contrasted to a similar exposure on a single layered element film prepared identically but without an overcoat, as shown in FIG. 1, curve 10 being the single layered element and curve 20 the composite. At a density of 1.0, curve 10 produced a relative exposure speed of 0.90 log E, while curve 20 produced a relative exposure speed of 1.25, an increase of about 0.3 log E. The average contrast, measured as described above, was lowered from 2.5 to 1.9.

EXAMPLE 2

A solution of 150.0 g of poly(alpha-chloroacrylonitrile) and 27.0 g of Saran F-120 was dissolved in 1,652.5 g of acetone and 120.0 g of butyrolactone. Solution was affected by gentle heating and stirring. To the polymer solution was added 19.90 g of N,N-dimethyl benzenediazonium fluoroborate. The diazo salt was dissolved by stirring at room temperature. The clear lacquer solution was coated on 4 mil poly(ethylene terephthalate) support and dried by heating to 120° C for 4 minutes. The film was then further coated with a solution of poly(vinyl alcohol) 2 mil thick, prepared by dissolving 9.0 g of poly(vinyl alcohol) in 91 g of water. The composite film was further dried by heating to 95° C for one minute.

Figure 2:
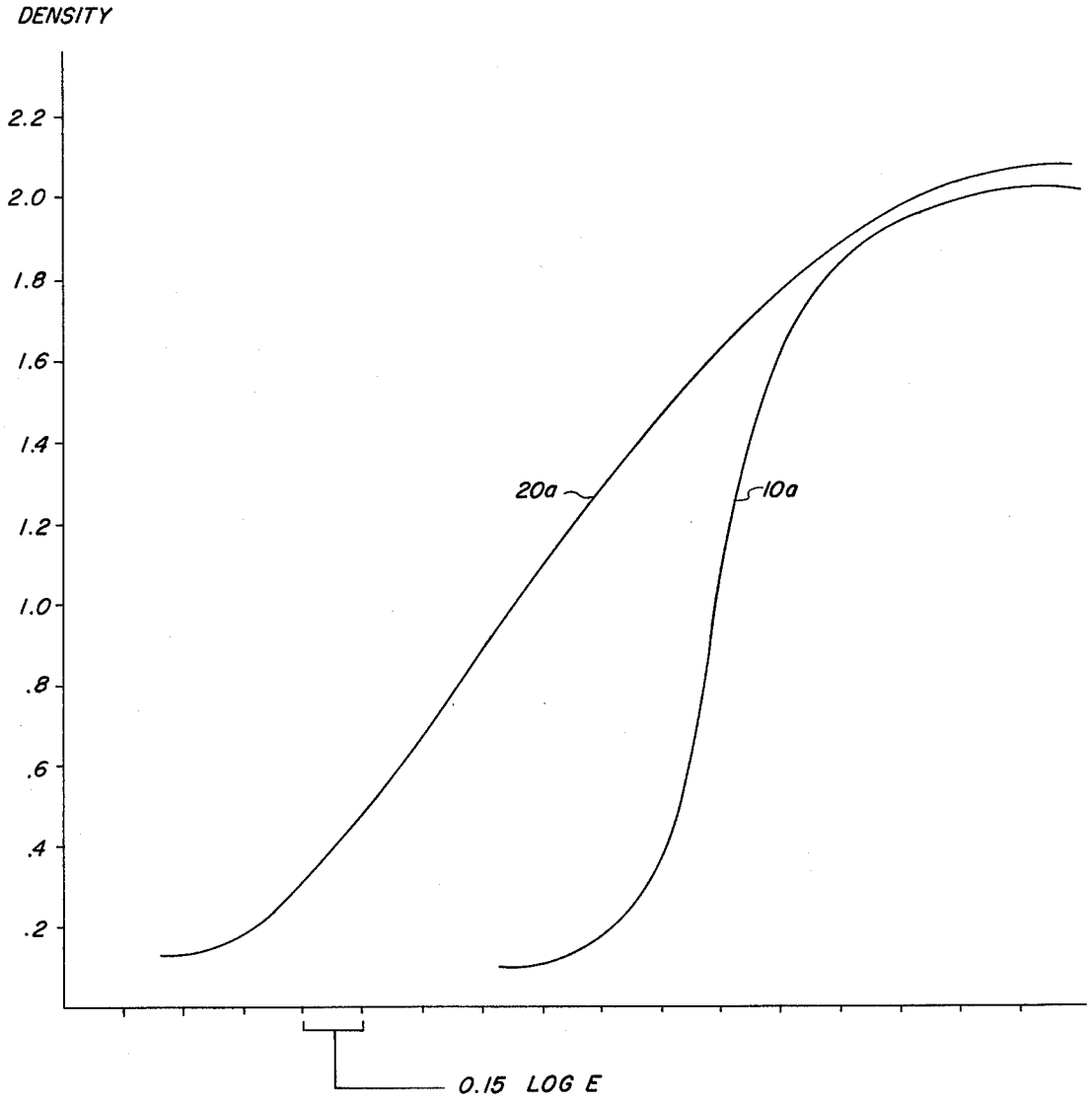

The composite film was next exposed and developed as described in Example 1. A low contrast high speed film was obtained as shown in FIG. 2, curve 10a being that of the single layered element and curve 20a being the composite. Specifically, the increase in speed was 0.52 log E and the average contrast was reduced from 2.5 to 1.2.

EXAMPLE 3

To illustrate the use of another Type II overcoat binder, a poly(alpha-chloroacrylonitrile)/"Saran F-120" film as described in Example 2 was prepared. A composite was prepared for this film by dissolving 2.0 g of sodium carboxymethylcellulose in 98 g of water by stirring and gentle heating. The solution of sodium carboxymethylcellulose was overcoated on the vesicular coating as a wet layer 2 mils thick. The composite was dried by heating to 95° C for 3 minutes to remove solvent.

Figure 3:
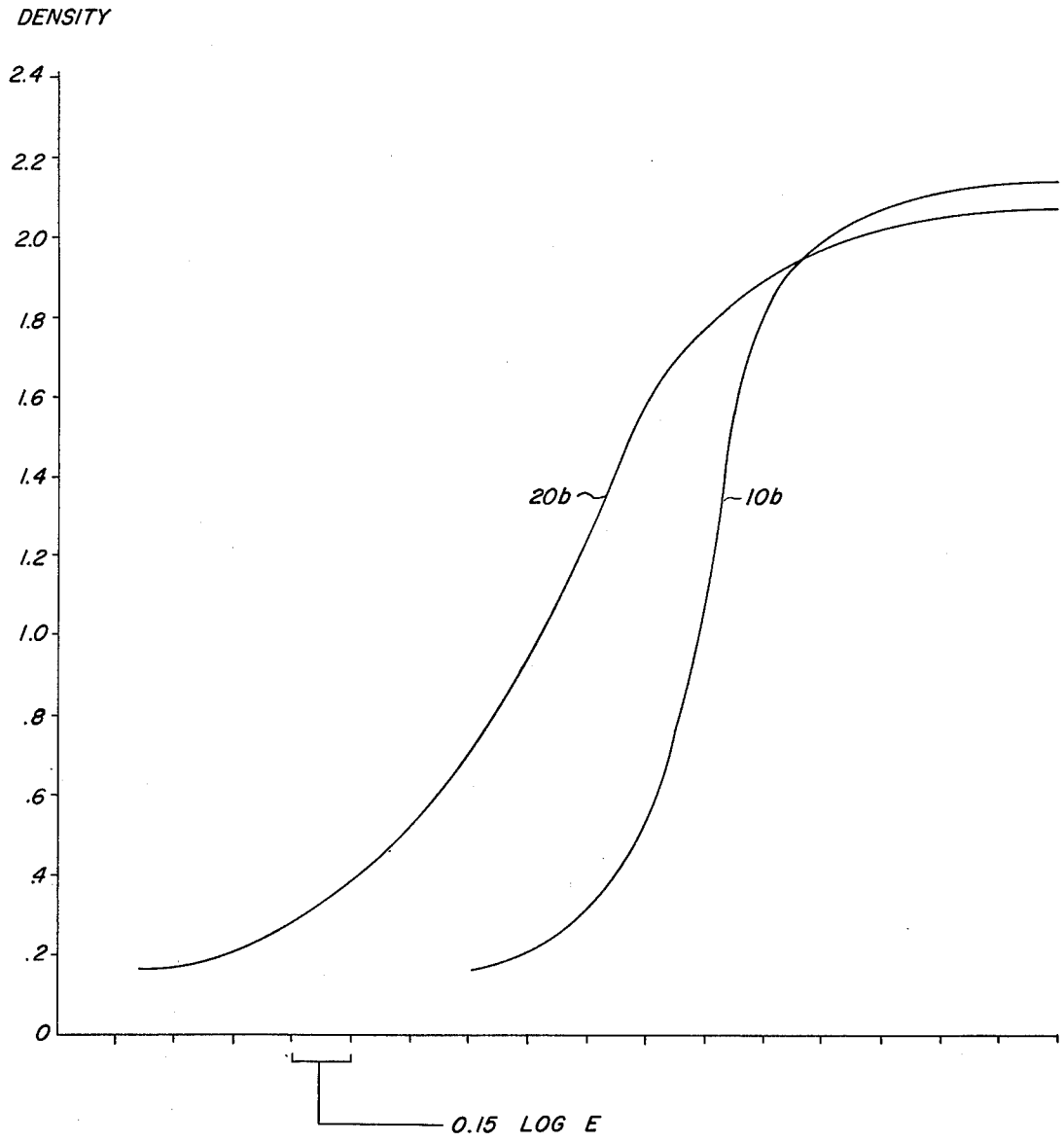

The composite film was exposed and developed as described in Example 1. A low-contrast, high speed film was obtained when compared to the single layered film as shown in FIG. 3, wherein curve 10*b* is for the single layered element, and curve 20*b* is for the composite element. The speed was increased in the composite element by 0.4 log E, and the average contrast decreased to 1.1 from 2.0 for the single-layered element.

EXAMPLE 4

Yet another composite element was prepared as in the case of Example 2, except that 5 g of gelatin in 95 g of water was used as the overcoat solution. Both the speed increase and the contrast decrease were observed as in the case of the previous examples.

EXAMPLES 5–12

In these examples, the Type I binder was varied, as was the vesiculating agent. A pair of coatings was made for each example, one being overcoated with poly(vinyl alcohol) and the other with gelatin. Specifically, the vesicular binder (i.e., matrix polymer) was dissolved in a quantity of methyl ethyl ketone sufficient to provide a solution containing 10% of the total solution weight as solids. A brilliant clear polymer solution was obtained in each case by stirring at room temperature. In the cases where a carbazido vesiculating agent was used, it was added in an amount equal to 5% of the dry weight of the polymer in solution. The diazo vesiculating agent was added equal to 10% of the polymer weight.

The methyl ethyl ketone solutions containing dissolved polymer and vesiculating agent were machine-coated on 4 mil poly(ethylene terephthalate) film support. The coating thicknesses were adjusted to provide 0.6 g of solids per square foot dry-weight coverage (i.e., 6.45 g/m$^2$). The coatings were dried by heating in moving air at 121° C for 18 minutes.

The gelatin and poly(vinyl alcohol) used in the overcoats were each dissolved in water sufficient to provide 5 g of polymer per 100 g of solution. The overcoat was applied over the vesicular coat using a 2 mil doctor blade and the composite film was dried by heating in an air stream at 66° C for three minutes.

The two-layer vesicular photographic elements as described above were each exposed on a "Recordak" Microfiche Diazo Printer, Model 404A manufactured by Eastman Kodak for equal lengths of time. After exposure the samples were then developed by heating the 125° C for two seconds. The relative film speed of each composite vesicular film was compared to a similar single-layer element which was identical except that it lacked an overcoat. As is seen from the following Table I, in each case the composite element with the overcoat has a greater film speed than the single layer film without the overcoat.

TABLE I

Relative Photographic Speeds (log E) of Composite Vesicular Films

| Example | Matrix Polymer | Vesiculating Agent | Overcoat: Poly(vinyl alcohol) | Overcoat: Gelatin | No Overcoat |
|---|---|---|---|---|---|
| 5 | poly(α-chloroacrylonitrile) 85%/Saran F-120 15% | α-carbazidonaphthol | 0.94 | 0.89 | 0.76 |
| 6 | poly(α-chloroacrylonitrile 85%/Saran F-120 15% | p-diazodiethylaniline borofluoride | 1.18 | 1.10 | 0.79 |
| 7 | Saran F-120 | α-carbazidonaphthol | 1.10 | 1.03 | 0.91 |
| 8 | Saran F-120 | p-diazodiethylaniline borofluoride | 1.02 | 1.20 | 0.97 |
| 9 | terpolymer of acrylic acid, vinylidene chloride and acrylonitrile | α-carbazidonaphthol | 0.76 | 0.72 | 0.70 |
| 10 | terpolymer of acrylic acid, vinylidene chloride and acrylonitrile | p-diazodiethylaniline borofluoride | 1.21 | 1.14 | 0.86 |
| 11 | copolymer of vinylidene chloride and acrylonitrile | α-carbazidonaphthol | 0.87 | 0.80 | 0.70 |
| 12 | copolymer of vinylidene chloride and acrylonitrile | p-diazodiethylaniline borofluoride | 1.26 | 1.20 | 0.93 |

EXAMPLES 13 and 14

In the following examples, the vesiculating or primary image-forming layer was coated using the binder of Example 2 and 10% by weight of 2,5-dimethoxy-4-morpholinobenzene diazonium hexafluorophosphate measured per total dry weight. Both examples were given prenucleation by incorporating stearic acid in the manner taught in *Research Disclosure,* Vol. 127, Publication No. 12709, November 1974. The elements were exposed on a Model 404A Printer as described in Examples 5–12, and developed by heating in a Canon Kalfile Processor at 130° C for 1.7 seconds. The binders used in the overcoats, the decrease in average contrast that was achieved and the increase in speed are set forth in Table II. The sensitometric data was obtained by comparing the results with a control which comprised the same imaging element but without the overcoat.

TABLE II

| Example | Overcoat Binder | Change in Ave. Contrast | Change in log E Speed |
|---|---|---|---|
| 13 | poly(acrylamide) | −1.3 | +0.25 |
| 14 | poly(acrylic acid) | −1.8 | +0.26 |

EXAMPLE 15 - 20

To illustrate the latent image stability period for elements of the invention, for each of these examples a coating solution was prepared by dissolving .990 g of poly(ethylene-co-1,4-cyclohexylenedimethylene-toluene-2, 4-disulfonamide in 9.90 g of acetone along with 0.110 g of p-diazodiethylaniline zinc chloride. The mixture was stirred at room temperature until a clean solution was obtained. The resulting clear lacquer solution was coated on a 4 mil poly(ethylene terephthalate) film support as a wet coating 5 mil thick. The coating was dried by heating on the coating block 5 minutes at 23.9° C and 5 minutes at 43.3° C. The coating was then removed from the coating block and further dried in an oven at 94° C for 30 min. After drying the polysulfonamide vesicular layer, a second layer of water soluble polymer was coated directly over the vesicular layer, as identified in Table III below.

This overcoat solution was prepared by dissolving 0.990 g of the water-soluble polymer in 12.600 ml of distilled water. The water soluble overcoat was coated using a 5 mil doctor blade. The composite two layer coating was dried on the coating block 1 minute at 23.9° C, 5 minutes at 60° C and further dried in an oven for 30 minutes at 95° C, leaving a calculated total dry thickness of about 11 microns. The dried coatings were cut into suitable strips and the latent image stability of the two layer composite vesicular images was measured as follows:

The strips were exposed for 18 seconds at ambient temperature through a carbon step wedge to an undoped mercury arc lamp at a distance of approximately 7.6 cm. The exposed vesicular images placed, without development, in an oven at 54° C. Sample strips of the exposed film were removed from the oven at frequent intervals and the latent image developed by contacting the element with an aluminum block heater at 145° C, for three seconds. The maximum image development for each developed sample was measured in a Macbeth spectral densitometer. These measurements were repeated until leakage of the nitrogen from the film gave a developed image density of 0.2.

A plot of the H&D curves for each composite film was compared to a similar film exposed and developed without the overcoat. It was observed from the data in Table III that the addition of the overcoat increased the film speed by as much as 0.67 log E (at a density of 1.0).

Table III

| Example | Overcoat | Minutes for Developable Image to Decay to Density D = 0.2 | Speed Increase Log E |
|---|---|---|---|
| 15 | Gelatin | 200 | .67 |
| 16 | Gum Arabic | 96 | .57 |
| 17 | Polyacrylic Acid | 111 | .66 |
| 18 | Polyvinyl Alcocol | 87 | .18 |
| 19 | Polyacrylamide | 90 | .34 |
| 20 | Polyvinyl Pyrrolidone | 42 | .02 |
| Control | No Overcoat | 32 | — |

EXAMPLES 21–23

The following sensitized layer formulations were prepared for these examples, on a percent by weight basis:

| Components | Ex. 21 | Ex. 22 | Ex. 23 |
|---|---|---|---|
| 10% poly(α-chloroacrylonitrile) in methyl ethyl ketone | 642.5 g | 642.4 g | 645.0 g |
| 10% poly(vinylidenechloride-co-acrylonitrile) in methyl ethyl ketone | 115.0 | 115.4 | 116.0 |
| Methyl ethyl ketone | None | 174.3 | 167.3 |
| Acetone | 221.3 | None | None |
| 4-Butyrolactone | 9.0 | 56.4 | 55.7 |
| 2,5-Dimethoxy-4-morpholinobenzene diazonium hexafluorophosphate | 10.5 | 10.5 | 10.6 |
| Eastman Polyester Blue GBT dye, manufactured by Tennessee Eastman Co. | 0.9 | 0.9 | 0.9 |
| Propylene oxide | None | None | 4.5 |

The following overcoat layer formulation was prepared:

| | |
|---|---|
| 3.8% filtered polyvinyl alcohol | 1046 g. |
| Distilled water | 2945 g. |
| Crosslinker | 9.3 g. |

wherein the crosslinker consists of:

| | |
|---|---|
| Tetraethylorthosilicate | 21.0 g. |
| Water | 5.1 g. |
| 1% by volume HCl | 1.2 g. |
| Absolute ethanol | 1.8 g. |

All three examples were machine coated to 4.3 g/m$^2$ dry coverage on 4-mil subbed poly(ethylene terephthalate). Portions of these coatings were then overcoated to 0.21 g/m$^2$ dry coverage with the above-described PVA overcoat solution, and identified as Ex. 21a, 22a, and 23a respectively.

Exposure conditions were those described in Ex. 5–12 and development was achieved by heating in a Canon Kalfile Processor at 130° C for about two seconds. Speeds and contrasts were calculated as per the preceding examples.

The following results were obtained:

| Example | Overcoat | Relative log E | Average Contrast |
|---|---|---|---|
| 21 | No | 0.86 | 9.7 |
| 21a | Yes | 1.23 | 6.5 |
| 22 | No | 0.89 | 4.1 |
| 22a | Yes | 1.15 | 5.0 |
| 23 | No | 0.86 | 4.6 |
| 23a | Yes | 1.14 | 4.8 |

From the above data it is seen that the use of the poly(vinyl alcohol) overcoat provides desired increased photographic speeds. These examples also demonstrate that the overcoat does not always provide a reduction in contrast when a non-nucleated vesicular formulation is used, as here.

COMPARATIVE EXAMPLES 1–6

To illustrate a composite element having an unacceptable latent image stability period, coatings were prepared exactly as described for Examples 15–20 except that cellulose acetate butyrate was used as the waterinsoluble vesicular binder instead of poly(ethylene-co-1,4-cyclohexylenedimethylene-toluene-2-4-disulfonamide). The dry thickness of the composite element was the same. Table IV clearly shows that the nitrogen escaped so rapidly that little or no image was developed. Only with polyacrylic acid was a density of 0.2 detectable and then only if measured with only 1.5 minutes of storage.

Table IV

| Comp Ex. | Overcoat | Latent Image Stability Period | Density of Image |
|---|---|---|---|
| 1 | gelatin | — | no image |
| 2 | polyvinyl alcohol | — | no image |
| 3 | polyacrylic acid | 1.5 | 0.2 |
| 4 | polyvinyl pyrrolidone | — | no image |
| 5 | sodium carboxymethyl cellulose | — | no image |
| 6 | no overcoat (control) | — | no image |

COMPARATIVE EXAMPLES 7&8

To indicate the importance of the prevention of strike-through, binders were selected for the overcoat that were soluble in the same solvent in which the binder of the primary image-forming layer was soluble. The vesiculating agent of Example 13 was added for both examples to poly(ethylene-co-1,4-cyclohexylenedimethylene-1-methyl-2,4-benzenedisulfonamide). The coating solutions were 23.5 weight percent solids in a 9.1 mixture of acetone and butyrolactone, coated to give a dry solids coverage of 0.7g/ft$^2$. Table V which follows indicates the polymer selected for the overcoat, and its amount. The solvent for the overcoat was, in both instances, an equal weight mixture of methyl ethyl ketone and acetone.

Table V

| Comp. Ex. | Polymer for Overcoat | Amount | Change in Average Contrast | Change in Speed (log E) |
|---|---|---|---|---|
| 7 | homopolymer of α-chloroacrylonitrite | ~2 g/m² | −1.0 | +0.10 |
| 8 | Saran F-120 | ~2 g/m² | +0.6 | +0.26 |

Although the average contrast was decreased in Comparative Example 7, the increase in speed was insufficient to be significant. Comparative Example 8 demonstrated an adverse increase in contrast.

COMPARATIVE EXAMPLES 9–11

Figure 4:
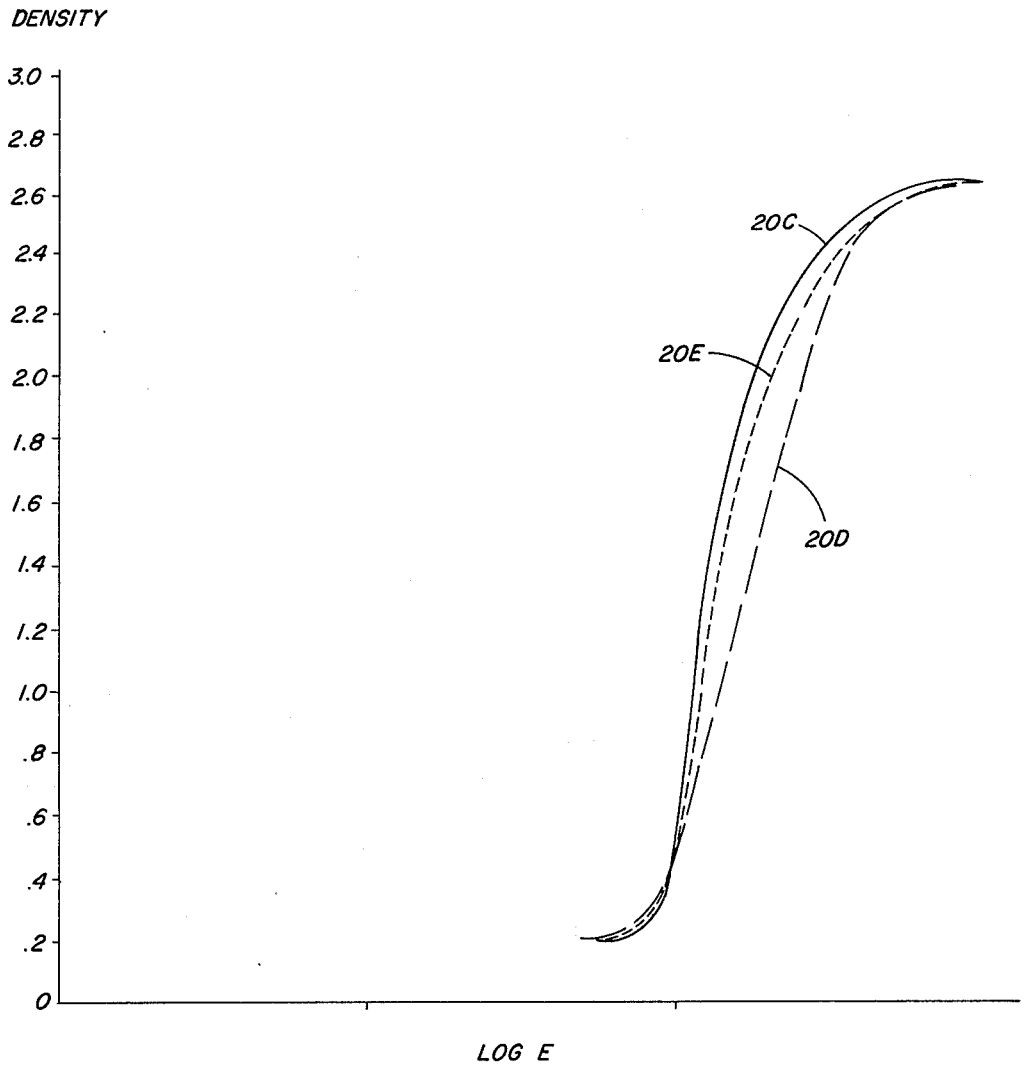

Examples were prepared to demonstrate that the improvements in contrast and speed achieved by overcoats using techniques of the prior art, i.e., with vesicular agents included, do not result from that, but rather from the overcoat per se. Three imaging elements were prepared for comparison. The first imaging element was formed by coating a solution of the binder of Example 5, containing the vesiculating agent of Example 13 as 12% of the binder weight. The binder solution was coated on the support, of sufficient thickness to provide 4.3 g/m² of solids after drying. An overcoat layer containing no vesiculating agent was cast in polyvinyl alcohol dissolved in water, to sufficient thickness to provide a polyvinyl alcohol overcoat layer of 0.22 g/m² after drying (Comparative Example 9). A second imaging element was prepared exactly as the first element except the polyvinyl alcohol overcoat layer contained 5% by weight of the vesiculating agent present in the bottom layer (Comparative Example 10). A third element was prepared exactly as the second but using 12% by weight of the vesiculating agent (Comparative Example 11). FIG. 4 illustrates the plots of the curves for these examples, curve 20c being comparative Example 9, 20*d* Comparative Example 10, and 20e Comparative Example 11. The scale of the abscissa, not shown, is substantially the same as that of FIG. 3. No significant improvement can be seen either in average contrast or in speed, for these three examples. Indeed, the speed if anything is decreased. Thus, the improvements are achieved by the binder of the overcoat, and not by any vesiculating agent added to it.

The invention has beed described in detail with particular reference to certain preferred embodiments thereof, but it will be understood that variations and modifications can be effected within the spirit and scope of the invention.

What is claimed is:

1. A radiation-sensitive vesicular imaging element comprising, in laminar relationship, (a) a support, (b) a first layer comprising a binder that is substantially insoluble in water and, uniformly distributed in said binder in an amount between about 1 and about 15% by weight of said binder, a radiation-sensitive nitrogen-releasing, vesiculating agent; and (c) a second layer superimposed over said first layer, said second layer comprising a water-soluble binder, said layer being substantially free of radiation-sensitive material, said binders together providing a latent image stability period for $N_2$ that is sufficient for vesicular imaging.

2. An element as defined in claim 1, wherein said period, when measured for said element having a calculated total dried thickness of said layers of about 11 microns and a concentration of said vesiculating agent of about 10% by dry weight of the first layer, is greater than about two minutes.

3. The element as defined in claim 1, wherein said agent is selected from the group consisting of diazonium salts, carbazido compounds and azides.

4. An element as defined in claim 1, wherein said water-soluble binder is selected from the group consisting of poly(vinyl alcohol), poly(acrylamide), poly(acrylic acid), gelatin and sodium carboxymethyl cellulose.

5. An element as defined in claim 4, and further including in said second layer a cross-linking agent.

6. An element as defined in claim 1, wherein said first layer binder is selected from the group of polymers consisting of poly(α-chloroacrylonitrile), poly(vinylidene chloride), poly(vinyl chloride, polystyrene and poly(acrylonitrile); copolymers of bisphenol A/epichlorohydrin; poly(sulfonamides); polyesters prepared from dibasic aromatic acids and at least one polyhydric alcohol; and mixtures thereof.

7. An element as defined in claim 1, and further including, in said second layer, a matting agent.

8. A radiation-sensitive vesicular imaging element having enhanced speed comprising, in laminar relationship, a support, a first layer comprising a mixture of poly( -chloroacrylonitrile) and poly(vinylidene chloride-co-acrylonitrile), and uniformly admixed with said mixture in an amount between about 1 and about 15% by weight of said binder, 2,5-dimethoxy-4-morpholinobenzene diazonium hexafluorophosphate;

and a second layer superimposed over said first layer and comprising poly(vinyl alcohol) and a crosslinking agent, said second layer being substantially free of radiation-sensitive material;

said polymers of said layers together providing a latent image stability period for $N_2$ that is sufficient for vesicular imaging.

9. An element as defined in claim 8, wherein said period, when measured for said element having a calculated total dried thickness of said layers of about 11 microns and a concentration of said vesiculating agent of about 10% by dry weight of the first layer, is greater than about two minutes.

10. An element as defined in claim 8, wherein said cross-linking agent comprises an orthosilicate salt and an inorganic acid.

11. An element as defined in claim 8, and further including in said second layer, a matting agent.

12. A radiation-sensitive vesicular imaging element having enhanced speed comprising, in laminar relationship, (a) a support, (b) a first layer comprising a binder selected from the group of polymers consisting of poly(α-chloroacrylonitrile, poly(vinylidene chloride), poly(vinyl chloride), polystyrene and poly(acrylonitrile); copolymers of bisphenolA/epichlorohydrin; poly(-sulfonamides); polyesters prepared from dibasic aromatic acids and at least one polyhydric alcohol; and mixtures thereof;

and, uniformly distributed in said binder in an amount between about 1 and about 15% by weight of said binder, a radiation-sensitive nitrogen-releasing vesiculating agent; and (c) a second layer superimposed over said first layer, said second layer comprising a binder selected from the group consisting of poly(vinyl alcohol, poly(acrylamide, poly(acrylic acid), gelatin and sodium carboxymethyl cellulose;

said binders together providing a latent image stability period for $N_2$ that is sufficient for vesicular imaging.

13. An element as defined in claim 12, wherein said period, when measured for said element having a calculated total dried thickness of said layers of about 11 microns and a concentration of said vesiculating agent of about 10% by dry weight of the first layer, is greater than about two minutes.

14. A method of manufacturing a vesicular print film having increased speed and reduced contrast, comprising the steps of:

(a) coating on a support a first polymeric layer comprising a binder that is substantially insoluble in water and, uniformly distributed in said binder in an amount between about 1 and about 15% by weight of said binder, a radiaton-sensitive nitrogen-releasing vesiculating agent;

(b) drying the coating;

(c) superimposing over the dried coating a second layer comprising a water-solution of a water-soluble polymer, said second layer being substantially free of a radiation-sensitive compound, said binder and said polymer together providing a latent image stability period for $N_2$ that is sufficient for vesicular imaging; and (d) drying the second layer.

15. A method as defined in claim 14, wherein said water-soluble polymer is selected from the group consisting of poly(vinyl alcohol), poly(acrylamide), poly(acrylic acid), gelatin and sodium carboxymethyl cellulose.

16. A method as defined in claim 15, wherein said first layer binder is selected from the group of polymers consisting of poly(α-chloroacrylonitrile), poly(vinylidene chloride), poly(vinyl chloride, polystyrene and poly(acrylonitrile); copolymers of bisphenol A/epichlorohydrin; poly(sulfonamides); polyesters prepared from dibasic aromatic acids and at least one polyhydric alcohol; and mixtures thereof.

17. A method of forming an image, comprising the steps of:

(a) exposing to activating radiation an element comprising, in laminar relationship, a support, a first layer comprising a binder that is substantially insoluble in water and, uniformly distributed in said binder in an amount between about 1 and about 15% by weight of said binder, a radiation-sensitive nitrogen-releasing vesiculating agent, and a second layer super-imposed over said first layer, said second layer comprising a water-soluble binder, said second layer being substantially free of radiation-sensitive material, said binders together providing a latent image stability period for $N_2$ that is sufficient for vesicular imaging; and (b) developing the element by heating to a temperature and for a time sufficient to expand into image-forming bubbles the gas formed as a result of the exposure-caused decomposition of the vesiculating agent.

18. A method as defined in claim 17, wherein said water-soluble binder is selected from the group consisting of poly(vinyl alcohol), poly(acrylamide), poly(acrylic acid), gelatin and sodium carboxymethyl cellulose.

19. A method as defined in claim 18, wherein said first layer binder is selected from the group of polymers consisting of poly(α-chloroacrylonitrile), poly(vinylidene chloride), poly(vinyl chloride, polystyrene and poly(acrylonitrile); copolymers of bisphenol A/epichlorohydrin; poly(sulfonamides); polyesters prepared from dibasic aromatic acids and at least one polyhydric alcohol; and mixtures thereof.

* * * * *

UNITED STATES PATENT AND TRADEMARK OFFICE

CERTIFICATE OF CORRECTION

PATENT NO. : 4,093,463

DATED : June 6, 1978

INVENTOR(S) : George Leland Fletcher and Michael Mosehauer

It is certified that error appears in the above-identified patent and that said Letters Patent are hereby corrected as shown below:

Column 5, line 50, that part of formula reading

" 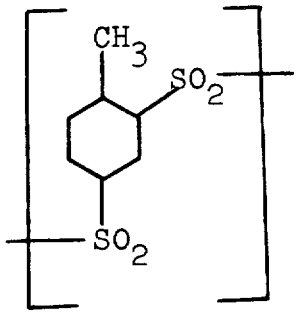 " should read -- 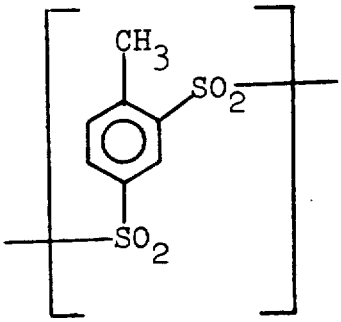 --

Column 6, line 25, "formaton" should read --formation--.

Column 14, line 33, "waterinsoluble" should read -- water-insoluble --.

Column 16, line 28, claim 8, "poly( -chloroa-" should read -- poly(α-chloroa- --.

Column 17, line 3, claim 12, "poly(vinyl alcohol," should read --poly(vinyl alcohol),--; line 4, claim 12, "poly(acrylamide," should read --poly(acrylamide),--.

UNITED STATES PATENT AND TRADEMARK OFFICE

CERTIFICATE OF CORRECTION

PATENT NO. : 4,093,463

DATED : June 6, 1978

INVENTOR(S) : George Leland Fletcher and Michael Mosehauer

It is certified that error appears in the above-identified patent and that said Letters Patent are hereby corrected as shown below:

Column 18, line 2, claim 16, "poly(vinyl chloride," should read --poly(vinyl chloride),--; line 34, claim 19, "poly(vinyl chloride," should read --poly(vinyl chloride),--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*